US007108803B1

(12) United States Patent
Mansfeld et al.

(10) Patent No.: US 7,108,803 B1
(45) Date of Patent: Sep. 19, 2006

(54) GAS ODORIZATION METHOD

(75) Inventors: Gerd Mansfeld, Eschershausen (DE); Ute Rohde, Höxter/Stahle (DE); Fritz Henke, Holzminden (DE); Heribert Kaesler, Bochum (DE)

(73) Assignee: Symrise GmbH & Co. KG, (DE)

( * ) Notice: Subject to any disclaimer, the term of this patent is extended or adjusted under 35 U.S.C. 154(b) by 0 days.

(21) Appl. No.: 09/762,847

(22) PCT Filed: Aug. 4, 1999

(86) PCT No.: PCT/EP99/05639

§ 371 (c)(1),
(2), (4) Date: Mar. 12, 2001

(87) PCT Pub. No.: WO00/11120

PCT Pub. Date: Mar. 2, 2000

(30) Foreign Application Priority Data

Aug. 17, 1998 (DE) ..... 198 37 066

(51) Int. Cl.
*C01B 31/20* (2006.01)

(52) U.S. Cl. ..... 252/372; 44/600

(58) Field of Classification Search ..... 252/372; 423/265; 44/600; 512/10
See application file for complete search history.

(56) References Cited

U.S. PATENT DOCUMENTS 3,620,982 A * 11/1971 Grossman ..... 512/13
4,487,613 A * 12/1984 Yoshida et al. ..... 48/197 FM
5,321,005 A * 6/1994 Mookherjee et al. ..... 512/5
6,296,889 B1 * 10/2001 Ott et al. ..... 426/534

FOREIGN PATENT DOCUMENTS

| | | |
|---|---|---|
| JP | 48-79804 | 10/1973 |
| JP | 76007481 | 3/1976 |
| JP | 51 034841 B | 9/1976 |
| JP | 78035562 | 9/1978 |
| JP | 83042235 | 9/1983 |
| JP | 87001998 | 1/1987 |

OTHER PUBLICATIONS

**Database WPI Section Ch, Week 197643 Derwent Publications Ltd., London, GB; Class E16., AN 1974-27718V, XP002125846 & JP 51 034841 B (Tokyo Gas Co LTD), Sep. 29, 1976 in der Anmeldung erwahnt Zusammenfassung.

** Database WPI Section Ch, Week 198039 Derwent Publications ltd., London, GB; Class A14, AN 1980-68432C XP002125847 & JP 55 104393 A (Nippon Zeon KK), Aug. 9, 1980 Zusammenfassung.

C. Gardner Swain et al. "Rates of Aminolysis", J. Am. Chem. Soc., 1955, vol. 77, pp. 3924-3962, no month.

* cited by examiner

*Primary Examiner*—Edward M. Johnson
(74) *Attorney, Agent, or Firm*—Akerman Senterfit; Stephan A. Pendor

(57) ABSTRACT

A mixture of acrylic acid and nitrogen compounds is particularly adapted to achieve a sulfur-free odorization of a gas.

10 Claims, No Drawings

GAS ODORIZATION METHOD

FIELD OF THE INVENTION

The present invention relates to the odorization of gas.

Town and coke-oven gases obtained by thermal processes contained intensely odoriferous components and therefore had a strong intrinsic odor, so that escaping gas could be readily detected.

BACKGROUND OF THE INVENTION

Because of its origin (natural gas) and a relatively high degree of purity, the gas used nowadays in the public network is in itself virtually odorless; if leakages are not noticed in good time, explosive gas/air mixtures with a high hazard potential quickly form. For safety reasons, gas is therefore odorized by adding odorants. For example, in Germany it is stipulated that all gases which do not have sufficient intrinsic odor and are distributed in the public gas supply (DVGW-Arbeitsblatt [Worksheet] G 260) are odorized in accordance with DVGW-Arbeitsblatt [Worksheet] G 280; DVGW=Deutscher Verein des Gas-und Wasserfaches e.V. [German Association on Gas and Water], Eschborn. These odorizing compositions are detectable even when highly diluted and, because of their extremely unpleasant odor, act, as is desired, as a warning signal for people. In Germany, approximately 90% of service gas is currently odorized with tetrahydrothiophene (THT) (12–25 mg/m$^3$); in addition, odorization using mercaptans or thioethers is also customary.

THT and mercaptans are highly suitable for reliable odorization of gas. However, in the context of treating the environment with more respect, it is to be noted that during the combustion of such odorized gases, sulfur dioxide forms as combustion product—only in small amounts at each individual combustion site, but, viewed on a countrywide scale, in amounts of a few hundred tons per year. It would be desirable to overcome this disadvantage; however, a number of requirements have to be satisfied:

1. The odor must be unpleasant and unmistakable (odors from kitchens and homes are excluded). It must act as a warning signal for people who smell escaped gas.
2. Everybody with an average sense of smell and average physiological condition must be able to detect the odor.
3. The warning odor stage (=average odor intensity) must be achieved before the ignition limit or a kinetic carbon monoxide content is reached.
4. The odorizing composition must be as nontoxic as possible and must not form any toxic combustion products.
5. The odorizing composition must have high volatility and evaporate leaving as little residue as possible.
6. A suitable odorizing composition must not condense at winter temperatures, nor separate, nor adhere to metallic pipes.
7. The odorizing composition must combust without leaving a residue.
8. The odorizing composition must be storage-stable and chemically resistant to the gas and to the plants. It must not promote corrosion, nor attack customary seals.

Attempts have already been undertaken to provide new gas odorizing compositions. Thus, the following, for example, have been proposed:

- alkyl acrylates, vinyl or alkyl ethers and mixtures thereof (JP 76-7481),
- n-valeric acid, optionally in combination with ethyl acrylate and/or triethylamine (JP 76-34 841),

- mixtures of sulfur compounds and aliphatic aldehyde (JP 78-35 562),
- cycohexene (JP 83-42 235),
- norbornene derivatives (JP 87-1998) and
- saturated ethers, saturated esters, and mixtures thereof with mercaptans.

SUMMARY OF THE INVENTION

It has now been found that, by additions of

A. acrylic $C_1$–$C_{12}$-, preferably $C_1$–$C_8$-alkyl, esters,

B. nitrogen compounds and optionally

C. antioxidants progressively odorized gas is obtained which largely combines the desired properties. The novel odorizing composition can be added to the gas in the same order of magnitude as sulfur-containing compounds and does not produce corrosion-promoting products upon combustion.

DETAILED DESCRIPTION OF THE INVENTION

The acrylic esters A include methyl acrylate, ethyl acrylate, n-propyl acrylate, isopropyl acrylate, n-butyl acrylate, isobutyl acrylate, tert-butyl acrylate, pentyl acrylate, hexyl acrylate, heptyl acrylate, octyl acrylate and dodecyl acrylate. In a preferred embodiment, mixtures of acrylic $C_1$–$C_6$-alkyl esters are used as component A; a particularly preferred combination comprises methyl acrylate and ethyl acrylate alongside one another. The acrylate mixtures can contain the lower and the higher esters in each case in the weight ratio of from 9:1 to 1:9, preferably 7:3 to 3:7.

Preferred nitrogen compounds B include primarily compounds

- with a flash point above 20° C., preferably above 40° C. (measured in accordance with ISO 2719),
- with a molecular weight of from 80 to 160, preferably 110 to 145,
- with a boiling point of from 90 to 210, preferably 110 to 165° C.

The nitrogen compounds B include, for example, lactones, such as caprolactone nitriles, such as 2-nonenenitrile and compounds of the formula

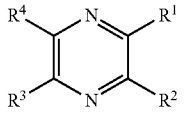

(I)

where $R^1$ to $R^4$, independently of one another, are hydrogen or $C_1$–$C_4$-alkyl, preferably methyl or ethyl.

Preferred compounds (I) are e.g. 2-methylpyrazine, 2,3-dimethylpyrazine, 2,6-dimethylpyrazine, 2,3,5-trimethylpyrazine, tetramethylpyrazine, 2-ethylpyrazine, 2,3-diethylpyrazine, 5,2-methylethylpyrazine, 2,3-methylethylpyrazine, 5,2,3-methyldiethylpyrazine and 3,5,2- and 3,6,2-dimethylethylpyrazine, 2,3-methylethylpyrazine and tetramethylpyrazine are preferred.

The nitrogen compounds B can be used in amounts of from 1 to 100, preferably 30 to 100, in particular 10 to 50, parts by weight per 1 000 parts by weight of A.

To protect against undesired oxidation, the odorizing compositions may comprise antioxidants, as are described, for example, in Römpp-Lexikon Chemie Version 1.3. Preferred antioxidants include butylhydroxyanisole, ionol=tert-butylhydroxytoluene, hydroquinone monomethyl ether and α-tocopherol.

The antioxidants C are preferably used in amounts of from 0.01 to 5, in particular 0.05 to 2, especially 0.1 to 1, parts by weight per 1 000 parts by weight of A.

Preferred gas odorizing compositions can, for example, have the following compositions:

EXAMPLE 1

| | |
|---|---|
| Ethyl acrylate | 600 g |
| Methyl acrylate | 360 g |
| 5,2,3-Methyldiethylpyrazine | 39 g |
| Ionol | 1 g |

EXAMPLE 2

| | |
|---|---|
| Ethyl acrylate | 535 g |
| Methyl acrylate | 400 g |
| 2-Methylpyrazine | 64 g |
| Ionol | 1 g |

EXAMPLE 3

| | |
|---|---|
| Ethyl acrylate | 320 g |
| Methyl acrylate | 637 g |
| 3,5(6),2-Dimethylethylpyrazine | 42 g |
| Ionol | 1 g |

EXAMPLE 4

| | |
|---|---|
| Ethyl acrylate | 460 g |
| Methyl acrylate | 460 g |
| 2,6-Dimethylpyrazine | 79 g |
| Ionol | 1 g |

EXAMPLE 5

| | |
|---|---|
| Ethyl acrylate | 520 g |
| Methyl acrylate | 459 g |
| 2,3,5-Trimethylpyrazine | 20 g |
| Ionol | 1 g |

EXAMPLE 6

| | |
|---|---|
| Ethyl acrylate | 885 g |
| Methyl acrylate | 100 g |
| 2,3-Methylethylpyrazine | 14 g |
| Ionol | 1 g |

EXAMPLE 7

| | |
|---|---|
| Ethyl acrylate | 700 g |
| Methyl acrylate | 274 g |
| 2,3-Dimethylpyrazine | 25 g |
| Ionol | 1 g |

EXAMPLE 8

| | |
|---|---|
| Ethyl acrylate | 350 g |
| Methyl acrylate | 600 g |
| Tetramethylpyrazine | 49 g |
| Ionol | 1 g |

EXAMPLE 9

| | |
|---|---|
| Ethyl acrylate | 144 g |
| Methyl acrylate | 800 g |
| 2-Ethylpyrazine | 56 g |

EXAMPLE 10

| | |
|---|---|
| Ethyl acrylate | 615 g |
| Methyl acrylate | 300 g |
| 5,2-Methylethylpyrazine | 85 g |

EXAMPLE 11

| | |
|---|---|
| Ethyl acrylate | 320 g |
| Methyl acrylate | 649 g |
| 3,5(6),2-Dimethylethylpyrazine | 15 g |
| 2,3-Dimethylethylpyrazine | 15 g |
| Ionol | 1 g |

EXAMPLE 12

| | |
|---|---|
| Ethyl acrylate | 120 g |
| Methyl acrylate | 807 g |
| 2-Ethylpyrazine | 30 g |
| 5,2-Methylethylpyrazine | 42 g |
| Ionol | 1 g |

EXAMPLE 13

| | |
|---|---|
| Ethyl acrylate | 520 g |
| Methyl acrylate | 434 g |
| 2,6-Dimethylpyrazine | 20 g |
| 2,3-Methylethylpyrazine | 25 g |
| Ionol | 1 g |

EXAMPLE 14

| | |
|---|---|
| Ethyl acrylate | 320 g |
| Methyl acrylate | 633 g |
| 2,3-Diethylpyrazine | 34 g |
| 2,3-Methylethylpyrazine | 12 g |
| Ionol | 1 g |

EXAMPLE 15

| | |
|---|---|
| Ethyl acrylate | 759 g |
| Methyl acrylate | 200 g |
| 2-Methylpyrazine | 30 g |
| Tetramethylpyrazine | 10 g |
| Ionol | 1 g |

What is claimed is:

1. A method of imparting odor to an odorless combustible gas, said method comprising:

adding to said odorless combustible gas

A. a mixture of two acrylic $C_1$–$C_{12}$-alkyl esters, wherein the weight ratio of the two acrylic esters is 9:1 to 1:9, B. at least one N compound with a boiling point of from 90 to 210° C. and a molecular weight of from 80 to 160 and optionally C. an antioxidant, wherein components A and B are odorants and are added to said combustible gas in an amount effective to act as a warning signal to warn of presence of said combustible gas in an enclosed space before an ignition limit of said combustible gas in said enclosed space is reached.

2. A combustible gas comprising:

1) an odorless gas; and 2) an odorizing composition comprising:

A. a mixture of two acrylic $C_1$–$C_{12}$-alkyl esters, wherein the weight ratio of the two acrylic esters is 9:1 to 1:9, B. at least one N compound with a boiling point of from 90 to 210° C. and a molecular weight of from 80 to 160 and optionally C. an antioxidant, wherein components A and B are odorants and are added to said combustible gas in an amount effective to act as a warning signal to warn of presence of said combustible gas in an enclosed space before an ignition limit of said combustible gas in said enclosed space is reached, and wherein said components A and B are substantially sulfur-free.

3. The method according to claim 1, wherein said at least one N compound is of the formula:

(I)

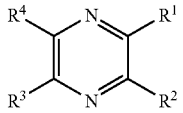

wherein $R^1$ to $R^4$, independently of one another, are hydrogen or $C_1$–$C_4$-alkyl.

4. The method according to claim 1, wherein said at least one N compound is present in an amount of from 1 to 100 parts by weight per 1,000 parts by weight of said Component A.

5. The method according to claim 1, wherein at least said antioxidant is used in an amount of from 0.01 to 5 parts by weight per 1,000 parts by weight of said Component A.

6. The method according to claim 1, wherein said odor imparting components that are added to said combustible gas are non-corrosive.

7. The gas according to claim 2, wherein said at least one N compound is of the formula:

(I)

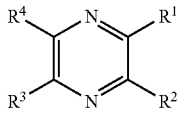

wherein $R^1$ to $R^4$, independently of one another, are hydrogen or $C_1$–$C_4$-alkyl.

8. The gas according to claim 2, wherein said at least one N compound is present in an amount of from 1 to 100 parts by weight per 1,000 parts by weight of said Component A.

9. The gas according to claim 2, wherein at least said antioxidant is used in an amount of from 0.01 to 5 parts by weight per 1,000 parts by weight of said Component A.

10. The gas according to claim 2, wherein said odor imparting components that are added to said combustible gas are non-corrosive.

* * * * *